US008996293B2

(12) United States Patent
Cooper et al.

(10) Patent No.: US 8,996,293 B2
(45) Date of Patent: Mar. 31, 2015

(54) SYSTEM AND METHOD FOR DETERMINING A SLACK CONDITION OF A VEHICLE SYSTEM

(71) Applicant: General Electric Company, Schenectady, NY (US)

(72) Inventors: Jared Klineman Cooper, Melbourne, FL (US); Robert James Foy, Melbourne, FL (US); Eugene Smith, Melbourne, FL (US); John Welsh McElroy, Melbourne, FL (US); Frank Wawrzyniak, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 8 days.

(21) Appl. No.: 13/896,668

(22) Filed: May 17, 2013

(65) Prior Publication Data

US 2014/0343835 A1 Nov. 20, 2014

(51) Int. Cl.
*B61L 23/00* (2006.01)

(52) U.S. Cl.
CPC ..... *B61L 23/00* (2013.01)
USPC ..... 701/300; 246/186

(58) Field of Classification Search
USPC ..... 701/19, 20, 300; 246/186, 167 R; 303/7; 105/6; 703/8
See application file for complete search history.

(56) References Cited

U.S. PATENT DOCUMENTS

| | | | | |
|---|---|---|---|---|
| 4,041,283 | A * | 8/1977 | Mosier | 701/20 |
| 6,219,595 | B1 * | 4/2001 | Nickles et al. | 701/19 |
| 6,273,521 | B1 * | 8/2001 | Halvorson et al. | 303/7 |
| 2001/0029411 | A1 * | 10/2001 | Hawthorne | 701/19 |
| 2008/0128562 | A1 * | 6/2008 | Kumar et al. | 246/186 |
| 2012/0259486 | A1 | 10/2012 | Brooks | |

* cited by examiner

*Primary Examiner* — Marthe Marc-Coleman
(74) *Attorney, Agent, or Firm* — GE Global Patent Operation; John A. Kramer

(57) ABSTRACT

A method for determining a slack condition of a vehicle system includes determining when each of first and second vehicles reaches a designated location along a route. The method also includes communicating a response message from the second vehicle to the first vehicle responsive to the second vehicle reaching the designated location, calculating a separation distance between the first vehicle and the second vehicle based on a time delay between a first time when the first vehicle reached the designated location and a second time when the second vehicle reached the designated location, and determining a slack condition of the vehicle system based on the separation distance. The slack condition is representative of an amount of slack in the vehicle system between the first and second vehicles.

20 Claims, 4 Drawing Sheets

SYSTEM AND METHOD FOR DETERMINING A SLACK CONDITION OF A VEHICLE SYSTEM

FIELD

Embodiments of the subject matter described herein relate to monitoring slack in a vehicle system having two or more vehicles connected together.

BACKGROUND

A vehicle "consist" is a group of vehicles that are mechanically coupled to travel together along a route. For example, a train is a type of vehicle consist comprising a group of rail vehicles coupled together to travel along a track. As the vehicle consist travels, forces on coupling mechanisms that connect adjacent vehicles in the consist may change. For example, accelerations and decelerations caused by changes in power outputs from the vehicle consist, changing grades in the terrain, curvatures in the route being traveled, and the like, may cause these mechanisms to experience tensile and compressive forces.

In order to safely operate the consist, the consist should be operated to keep the forces exerted on the coupling mechanisms from becoming too large (e.g., too large of tensile forces) or too small (e.g., too large of compressive forces). If the tensile forces become too large, the coupling mechanisms may break and thereby break apart the consist. If the compressive forces become too large, the vehicles connected by the coupling mechanisms may collide with each other.

Some techniques for monitoring the forces exerted on couplers include adding force sensors to the coupling mechanisms in order to measure the forces experienced by the coupling mechanisms. But, adding these sensors adds to the cost and complexity of the consist.

BRIEF DESCRIPTION

In an embodiment, a method (e.g., for determining a slack condition of a vehicle system) includes determining when each of a first vehicle and a second vehicle in the vehicle system reaches a designated location along a route being traveled by the vehicle system. The vehicle system includes at least the first and second vehicles interconnected with each other. The method also includes communicating a response message from the second vehicle to the first vehicle responsive to the second vehicle reaching the designated location, calculating a separation distance between the first vehicle and the second vehicle based on a time delay between a first time when the first vehicle reached the designated location and a second time when the second vehicle reached the designated location, and determining a slack condition of the vehicle system based on the separation distance. The slack condition is representative of an amount of slack in the vehicle system between the first and second vehicles. In another embodiment, the method further comprises automatically or otherwise controlling the vehicle system based on the slack condition that is determined. For example, if the slack condition indicates that a section of the vehicle system is experiencing relatively large compressive tensile forces, the method may further include automatically increasing the tractive efforts (and/or decreasing the braking efforts) generated by a vehicle that is disposed ahead of this section (along a direction of travel of the vehicle system) and/or decreasing the tractive efforts (and/or increasing the braking efforts) generated by another vehicle that is disposed behind the section (along the direction of travel).

In an embodiment, a system (e.g., for determining a slack condition of a vehicle system) includes a location determination device, a time monitoring device, and a slack determination device. The location determination device is configured to be disposed onboard a first vehicle of a vehicle system that also includes at least a second vehicle interconnected with the first vehicle for traveling along a route. The location determination device also is configured to determine locations of the first vehicle along the route. The time monitoring device is configured to determine when the first vehicle reaches a designated location along the route based on one or more of the locations determined by the location determination device. The slack determination device is configured to be disposed onboard the first vehicle and configured to receive a response message communicated by the second vehicle to the first vehicle. The response message identifies when the second vehicle reached the designated location. The slack determination device also is configured to calculate a separation distance between the first vehicle and the second vehicle based on a time delay between a first time when the first vehicle reached the designated location and a second time when the second vehicle reached the designated location. The slack determination device is further configured to determine a slack condition of the vehicle system based on the separation distance. The slack condition is representative of an amount of slack in the vehicle system between the first and second vehicles. The vehicle system may be automatically or otherwise controlled based on the slack condition that is determined.

In an embodiment, a system (e.g., for determining a slack condition of a vehicle system) includes a communication device, a location determination device, and a second time monitoring device. The communication device is configured to receive a request message from a leading vehicle in a vehicle system that also includes at least a following vehicle interconnected with the leading vehicle for traveling along a route. The leading vehicle is disposed ahead of the following vehicle in the vehicle system along a direction of travel of the vehicle system. The request message identifies an upcoming designated location along the route. The location determination device is configured to be disposed onboard the following vehicle and to determine locations of the following vehicle along the route. The second time monitoring device is configured to determine when the following vehicle reaches the designated location along the route based on one or more of the locations determined by the location determination device. The second time monitoring device also is configured to determine when the following vehicle reaches the designated location responsive to the following vehicle receiving a request message from the leading vehicle that identifies the designated location. The communication device also is configured to communicate a response message to the leading vehicle. The response message indicates when the following vehicle reached the designated location for use by a slack determining device of the leading vehicle to determine a slack condition of the vehicle system between the leading and following vehicles based on a difference in time between when the leading vehicle reached the designated location and when the following vehicle reached the designated location.

BRIEF DESCRIPTION OF THE DRAWINGS

The subject matter described herein will be better understood from reading the following description of non-limiting embodiments, with reference to the attached drawings, wherein below.

DETAILED DESCRIPTION

Figure 1:
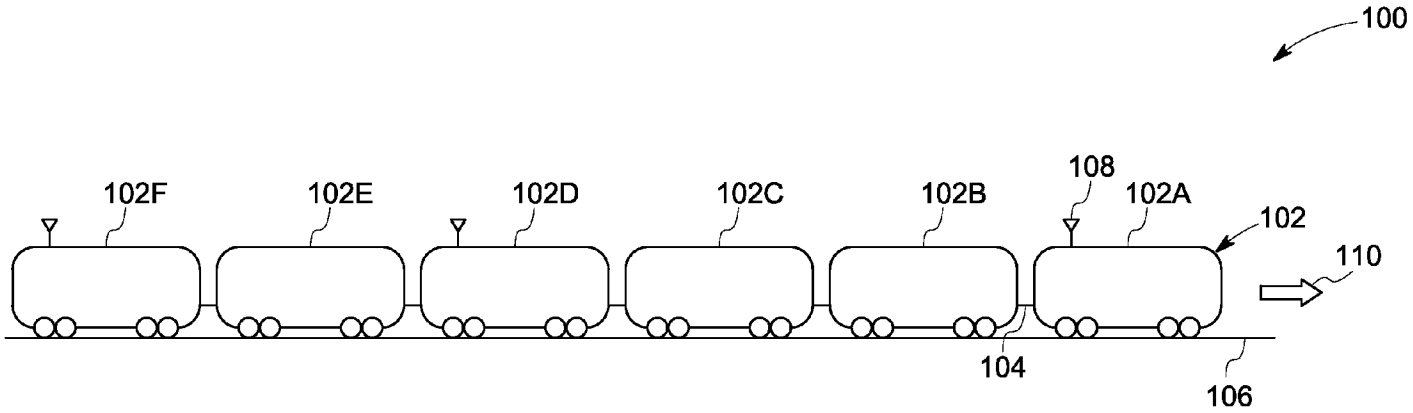
FIG. 1 is a schematic diagram of an embodiment of a vehicle system.

Embodiments of the inventive subject matter relate to determining slack conditions in a vehicle system that includes plural vehicles interconnected with each other based on when two or more of the vehicles reach a designated location along a route being traveled by the vehicle system. The slack conditions may represent amounts of slack in coupling mechanisms (e.g., couplers) that connect the vehicles to each other in the vehicle system. A slack condition may represent that the vehicle system is stretched such that coupling mechanisms disposed between the two or more of the vehicles are in tension (e.g., are experiencing positive tension forces or negative compression forces). Another slack condition may represent that the vehicle system is compressed such that the coupling mechanisms disposed between the two or more of the vehicles are in compression (e.g., are experiencing positive compression forces or negative tension forces). The slack condition of the vehicle system (e.g., between the two or more vehicles) may be used to control operations of the vehicle system and/or a trip plan that the vehicle system is following to provide for improved control over the vehicle system, improved handling of the vehicle system by a human operator, reduced wear and tear on the coupling mechanisms, reduced risk of breaking the coupling mechanisms, reduced risk of impact between adjacent vehicles in the vehicle system, and the like.

Reference will be made below in detail to embodiments of the inventive subject matter, examples of which are illustrated in the accompanying drawings. Wherever possible, the same reference numerals used throughout the drawings refer to the same or like parts. Although embodiments of the inventive subject matter are described with respect to trains, locomotives, and other rail vehicles, embodiments of the inventive subject matter also are applicable for use with vehicles generally, such as off-highway vehicles, agricultural vehicles, transportation vehicles, and/or marine vessels, each of which may be included in a vehicle consist. As noted above, a vehicle consist (e.g., locomotive consist) is a group of vehicles (e.g., locomotives) that are mechanically coupled or linked together to travel along a route, with each vehicle in the consist being adjacent to one or more other vehicles in the consist.

FIG. 1 is a schematic diagram of an embodiment of a vehicle system 100. The vehicle system 100 also may be referred to a vehicle consist. The vehicle system 100 includes two or more vehicles 102 (e.g., vehicles 102A-F) that are interconnected with each other by coupling mechanisms 104, such as couplers. The vehicles 102 are connected such that the vehicles 102 travel along a route 106 together. Although six vehicles 102 are shown in FIG. 1, the vehicle system 100 may include as few as two vehicles 102 or another number of vehicles 102. At least some of the vehicles 102 include communication devices 108 that permit the vehicles 102 to communicate with each other. While only three vehicles 102 are shown as having the communication devices 108, optionally as few as two or more than three vehicles 102 may include the communication devices 108. In the illustrated example, the communication devices 108 wirelessly communicate between the vehicles 102. Optionally, the communication devices 108 may communicate with each other via one or more wired connections extending between the vehicles 102.

One or more of the vehicles 102 are propulsion-generating vehicles that generate propulsive force (e.g., tractive effort) to propel the vehicle system 100 along the route 106. For example, some of the vehicles 102 may be locomotives or other types of vehicles that perform work to move the vehicle system 100. Optionally, at least one of the vehicles 102 may be a non-propulsion-generating vehicle that does not generate tractive effort. For example, one or more of the vehicles 102 may represent a rail car or another type of vehicle that carries cargo and/or passengers while not generating tractive effort. In one aspect, the vehicles 102 that include the communication devices 108 may be propulsion-generating vehicles while the vehicles 102 that do not include the communication devices 108 are non-propulsion-generating vehicles.

The propulsion-generating vehicles 102 in the vehicle system 100 may operate in a distributed power (DP) configuration, where the tractive efforts and/or braking efforts generated by the propulsion-generating vehicles 102 are coordinated with each other (e.g., based on each other) and/or controlled from a controlling vehicle 102, such as the vehicle 102A. The DP configuration may be a synchronous configuration (where all or a substantial number of the propulsion-generating vehicles 102 use the same throttle and/or brake settings) or an asynchronous configuration (where the throttle and/or brake settings of the propulsion-generating vehicles 102 are different). The controlling vehicle 102 need not, however, be disposed at the head or front end of the vehicle system 100 along a direction of travel 110 of the vehicle system 100. The controlling vehicle 102 may be disposed behind one or more, or all, of the other vehicles 102 in the vehicle system 100.

Figure 2:
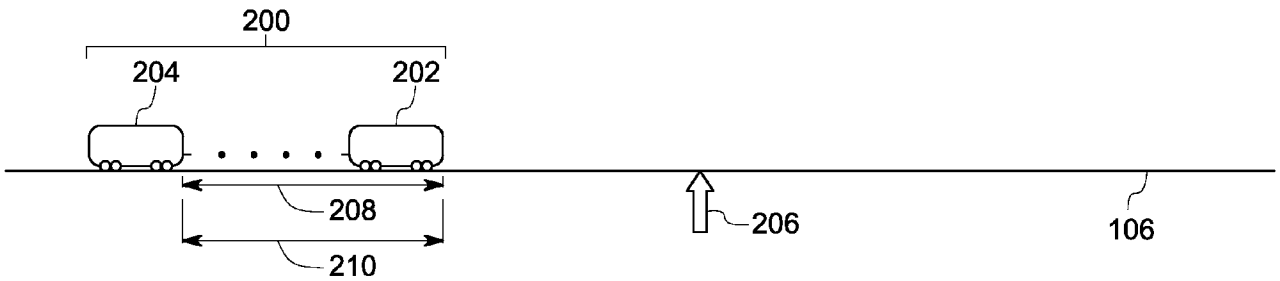
FIG. 2 is a schematic diagram of an embodiment of a vehicle system.
Figure 3:
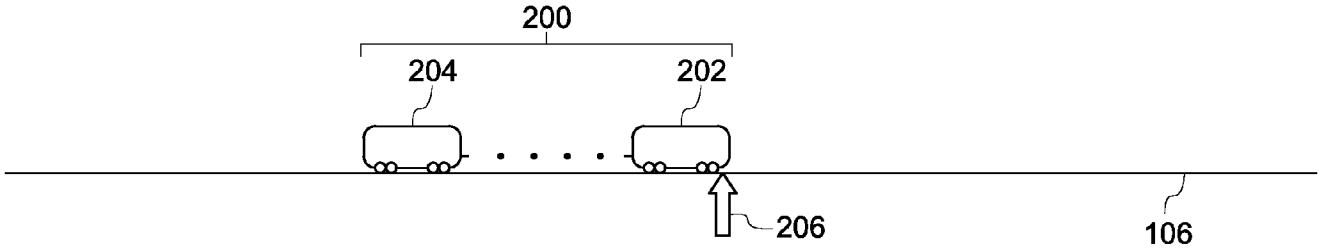
FIG. 3 is another schematic diagram of the vehicle system shown in FIG. 2.
Figure 4:
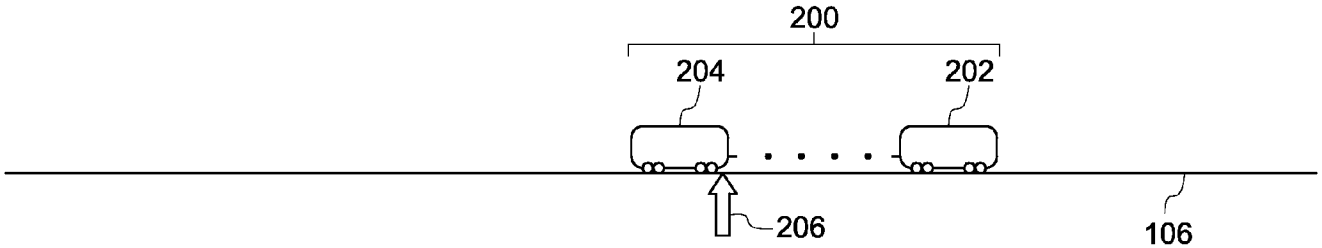
FIG. 4 is another schematic diagram of the vehicle system shown in FIGS. 2 and 3.

FIGS. 2 through 4 are schematic diagrams of an embodiment of a vehicle system 200. The vehicle system 200 may represent a portion of the vehicle system 100 shown in FIG. 1. For example, the vehicle system 200 may include a first or leading vehicle 202 and a second or following vehicle 204. The leading and following vehicles 202, 204 may represent vehicles 102 in the vehicle system 100, where the leading vehicle 202 represents a vehicle 102 that travels ahead of the vehicle 102 represented by the following vehicle 204 along the direction of travel 110 of the vehicle system 200.

With continued reference to FIGS. 2 through 4, FIG. 5 illustrates a flowchart of an embodiment of a method 500 for determining a slack condition of a vehicle system. The method 500 may be used in conjunction with the vehicle system 100 and/or 200 to determine slack conditions between two or more of the vehicles 102, 202, 204. Optionally, the method 500 may be used with another vehicle system that includes two or more connected or interconnected vehicles.

In an embodiment, two or more of the vehicles 202, 204 in the vehicle system 200 communicate with each other in order to determine when the vehicles 202, 204 reach (e.g., travel by) a designated location 206 along the route 106. Because one vehicle 204 follows the other vehicle 202, the vehicle 202 reaches the designated location 206 prior to the vehicle 204. For example, the vehicle 202 reaches the designated location 206 at the time represented by FIG. 3 while the vehicle 204 reaches the designated location 206 at a later time represented by FIG. 4. A time delay between when these vehicles 202, 204 reach the designated location 206 may be used to calculate a separation distance between the vehicles 202, 204. Optionally, additional time delays between the different times when other pairs of the vehicles in the vehicle system reach the designated location 206 may be calculated.

The time delay is used to compute a separation distance 208 between the vehicles 202, 204. The separation distance 208 is compared to a designated (e.g., known) distance 210 between the vehicles 202, 204. Based on this comparison, a slack condition that represents an amount of slack in the coupling mechanisms 104 (shown in FIG. 1) can be determined.

Figure 5:
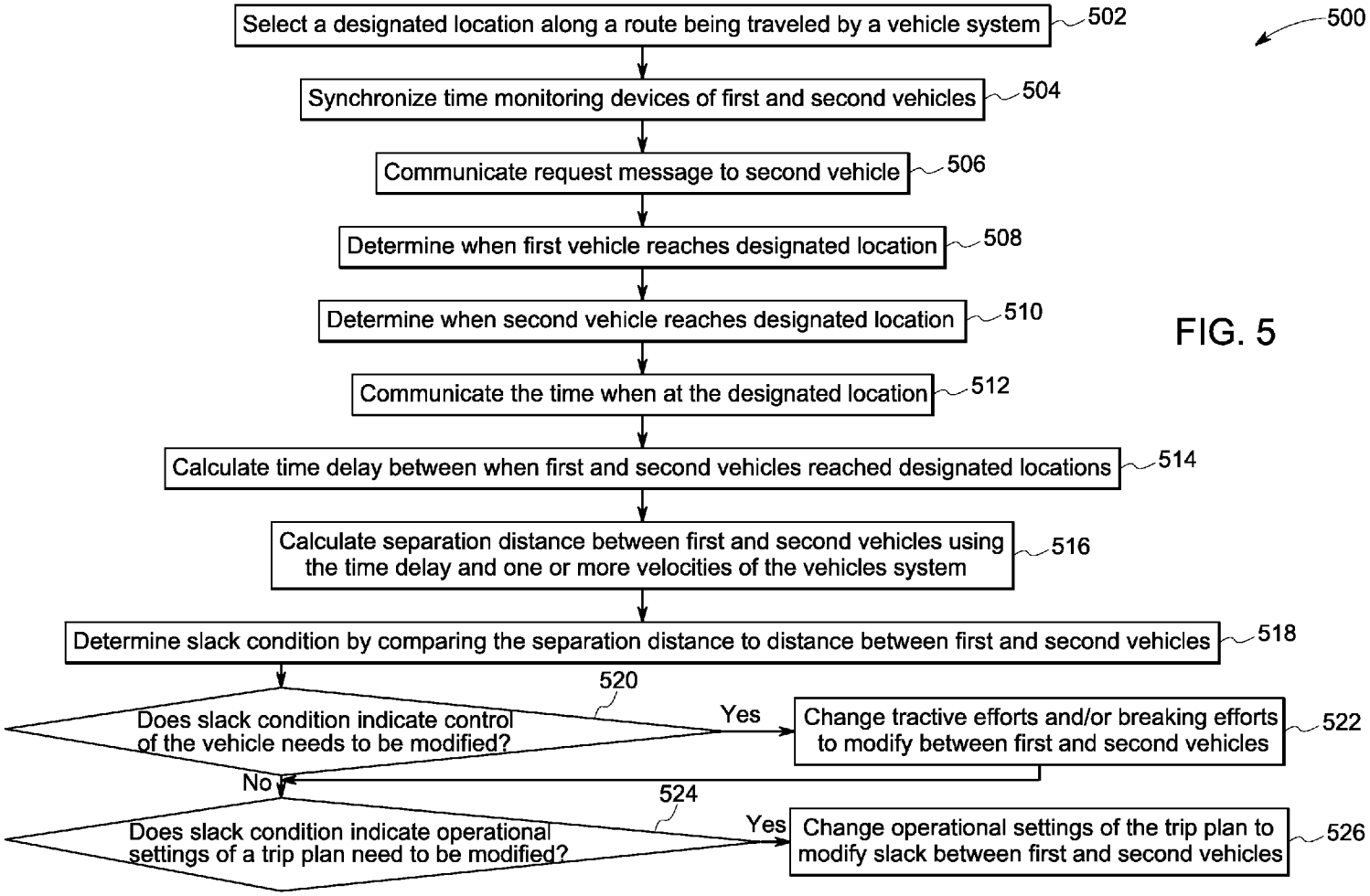
FIG. 5 illustrates a flowchart of an embodiment of a method for determining a slack condition of a vehicle system.

With respect to the method 500 shown in FIG. 5, as 502, the designated location 206 along the route 106 being traveled by the vehicle system 200 is selected. The designated location 206 may be selected based on terrain of the route 106. For example, the designated location 206 may be identified as a location of a feature of interest in the route 106. The feature of interest may be a location at or near where changes in the slack condition in the vehicle system 200 are expected to occur. For example, the designated location 206 may be selected at an inflection point in grades of the route 106. An inflection point may represent a location along the route 106 where the grade or curvature of the route 106 changes, such as by changing from an incline to a decline, a convex curve to a concave curve, or the like. The designated location 206 may be located in a valley disposed between a decline and an incline in the route 106. Other examples of the designated location 206 may be at a start of an inclined portion of the route 106, an end of a declined portion of the route 106, or an apex between an incline and a decline in the route 106. The designated location 206 may be automatically selected or may be manually selected by an operator of the vehicle system 200.

At 504, times being monitored by the vehicles 202, 204 are synchronized. As described below, the vehicles 202, 204 may have separate time monitoring devices that separately track time. In order to provide for increased accuracy in calculating the separation distance 208, the vehicles 202, 204 may communicate with each other in order to ensure that both vehicles 202, 204 are measuring the same time and are not significantly offset from each other.

At 506, a request message is communicated to the following vehicle 204. This request message may be transmitted or broadcast by the leading vehicle 202 or from another location. The request message may be wirelessly communicated to the vehicle 204 and/or may be communicated through one or more conductive pathways of the vehicle system 200 (e.g., a multiple unit, or MU, bus, a train line, or the like). The request message identifies the designated location 206 along the route 106 to the following vehicle 204. Optionally, the request message may be communicated from the following vehicle 204 to the leading vehicle 202.

At 508, the time at which the leading vehicle 202 reaches the designated location 206 is determined. A location determining device onboard the leading vehicle 202 may monitor locations of the leading vehicle 202 and determine when the leading vehicle 202 reaches the designated location 206. The time monitoring device of the leading vehicle 202 may indicate the time at which the leading vehicle 202 is at the designated location 206, as determined by the location determining device.

At 510, the time at which the following vehicle 204 reaches the designated location 206 is determined. A location determining device onboard the following vehicle 204 may monitor locations of the following vehicle 204 and determine when the following vehicle 204 reaches the designated location 206. The time monitoring device of the following vehicle 204 may indicate the time at which the following vehicle 204 is at the designated location 206, as determined by the location determining device.

At 512, the time at which at least one of the vehicles 202 or 204 reached the designated location 206 is communicated, such as to the other vehicle 204 or 202. For example, the following vehicle 204 may communicate the time at which the following vehicle 204 reached the designated location 206 in a response message that is transmitted or broadcast to the leading vehicle 202. The response message may be communicated in response to receiving the request message and to arriving at or passing by the designated location 206.

In one aspect, the response message may include the velocity at which the vehicle is traveling. For example, in addition to communicating the time at which the vehicle 204 reached the designated location 206, the vehicle 204 also may communicate the speed at which the vehicle 204 is traveling or was traveling when the vehicle 204 reached the designated location 206. This speed may be used to calculate the separation distance between the vehicles 202, 204, as described below.

At 514, a time delay between the times at which the different vehicles 202, 204 reached the designated location 206 is calculated. For example, if the time monitoring devices of the vehicles 202, 204 are synched with each other, the time period between when the leading vehicle 202 reached the designated location 206 (as monitored by the time monitoring device of the leading vehicle 202) and when the following vehicle 204 reached the designated location 206 (as monitored by the time monitoring device of the following vehicle 204) may be the time delay.

Using the time monitoring devices disposed onboard the different vehicles 202, 204 to monitor the times at which the vehicles 202, 204 reach the same designated location 206 can avoid inaccuracies in calculation of the time delay that are otherwise caused by one of the vehicles 202 or 204 transmitting a signal to the other vehicle 204 or 202 to merely indicate that the vehicle 202 or 204 has reached the designated location 206. For example, a communication from the following vehicle 204 to the leading vehicle 202 that merely indicates that the following vehicle 204 has reached the designated location 206 may be delayed during transmission. Upon receipt of the delayed communication, the leading vehicle 202 may not be able to accurately measure the time delay between when the two vehicles 202, 204 reached the designated location 206 because the delay calculated at the leading vehicle 202 may include at least some period of time caused by transmission delays.

At 516, the separation distance 208 between the vehicles 202, 204 is calculated. The separation distance 208 may be calculated from the time delay determined at 514 and one or more velocities at which the vehicle system 200 and/or vehicles 202, 204 are or were traveling. As described above, the speed at which the vehicle 204 is or was traveling can be communicated in the response message to the vehicle 202.

If the vehicle system 200 travels at a constant or approximately constant speed, then this speed may be multiplied by the time delay to determine the separation distance 208. Optionally, if the vehicle system 200 travels at varying speeds, then these speeds may be integrated with respect to time over the period of the time delay to determine the separation distance 208. The separation distance 208 can be measured along a path traversed by the route 106. For example, if the route 106 includes one or more non-linear portions between the vehicles 202, 204 during the time period that extends between when the leading vehicle 202 reached the designated location 206 and when the following vehicle 204 reached the designated location 206, then the separation distance 208 may represent the distance along these non-linear portions of the route 106.

The separation distance 208 that is determined may represent the distance between location determining devices disposed onboard the vehicles 202, 204 that determine locations of the vehicles 202, 204. Because these devices may not be disposed on the back end of the leading vehicle 202 and the front end of the following vehicle 202, 204, the separation distance 208 may not necessarily represent the actual distance between the vehicles 202, 204. Instead, the separation distance 208 may include at least a portion of the length of the leading vehicle 202 (as shown in FIG. 2) and/or at least a portion of the length of the following vehicle 202, depending on where the location determining devices are located onboard the respective vehicles 202, 204. Optionally, the separation distance 208 may be corrected by subtracting portions of the lengths of the vehicles 202, 204 so that the separation distance 208 more accurately represents the actual distance between the back end of the leading vehicle 202 and the front end of the following vehicle 204.

At 518, a slack condition of the vehicle system 200 is determined. The slack condition may be determined by comparing the separation distance 208 to a designated distance 210 between the vehicles 202, 204. The designated distance 210 may represent the actual distance between the vehicles 202, 204 along the path traversed by the route 106 between the vehicles 202, 204 or may represent the distance between the vehicles 202, 204 that includes one or more portions of the lengths of the vehicles 202 and/or 204, as described above.

The slack condition can represent the amount of slack in the coupling mechanisms 104 disposed between the vehicles 202, 204 in the vehicle system 200. The slack condition may indicate an overall amount of slack as opposed to the actual amount of slack in any specific one of the coupling mechanisms 104 and/or an actual amount of force exerted on a specific one of the coupling mechanisms 104. Optionally, the slack condition may be used to infer or estimate the forces exerted on one or more of the coupling mechanisms 104 disposed between the vehicles 202, 204.

For example, if the separation distance 208 is longer than the designated distance 210, then a slack condition that indicates the coupling mechanisms 104 between the vehicles 202, 204 are in tension (or negative compression) is identified. Conversely, if the separation distance 208 is shorter than the designated distance 210, then a slack condition that indicates the coupling mechanisms 104 between the vehicles 202, 204 are in compression (or negative tension) is identified.

At 520, a determination is made as to whether the identified slack condition indicates that control of the vehicle system 200 needs to be modified. For example, a slack condition may indicate that the large slack in the coupling mechanisms 104 infers that the coupling mechanisms 104 are experiencing relatively large compressive forces and may be at risk for allowing adjacent vehicles to slam into each other. As another example, the slack condition may indicate that a small (or negative) slack in the coupling mechanisms 104 infers that the coupling mechanisms 104 are experiencing relatively large tensile forces and may be at risk for breaking apart.

The slack condition may be compared to one or more designated limits to determine if control of the vehicle system 200 should be modified in order to reduce or increase the slack condition toward safer levels. In one aspect, if the slack condition indicates relatively large compressive forces, the tractive effort and/or braking effort generated by the vehicle 202 and/or vehicle 204 (and/or another propulsion-generating vehicle) may need to be modified. For example, the braking effort generated by the leading vehicle 202 (and/or another propulsion-generating vehicle) may need to be modified (e.g., decreased), the tractive effort generated by the following vehicle 204 (and/or another propulsion-generating vehicle) may need to be modified (e.g., decreased), and/or the braking effort generated by the following vehicle 204 (and/or another propulsion-generating vehicle) may need to be modified (e.g., increased). Changing one or more of the tractive efforts and/or braking efforts in this way can reduce the compression experienced by the coupling mechanisms 104 and, as a result, reduce the slack condition to within acceptable (e.g., designated) limits.

In one aspect, if the slack condition indicates relatively large tensile forces, the tractive effort and/or braking effort generated by one or more of the vehicles 202, 204 (and/or another propulsion-generating vehicle) may need to be modified. For example, the tractive effort generated by the leading vehicle 202 (and/or another propulsion-generating vehicle) may need to be decreased, the braking effort generated by the leading vehicle 202 (and/or another propulsion-generating vehicle) may need to be increased, the tractive effort generated by the following vehicle 204 (and/or another propulsion-generating vehicle) may need to be increased, and/or the braking effort generated by the following vehicle 204 (and/or another propulsion-generating vehicle) may need to be decreased. Changing one or more of the tractive efforts and/or braking efforts in this way can reduce the tension experienced by the coupling mechanisms 104 and, as a result, increase the slack condition to within acceptable (e.g., designated) limits.

If the slack condition indicates that control of the vehicle system 200 needs to be modified to bring the slack condition to within acceptable limits, flow of the method 500 may proceed to 522. On the other hand, if the slack condition indicates that control of the vehicle system 200 does not need to be modified to bring the slack condition to within acceptable limits, flow of the method 500 may proceed to 524.

At 522, the tractive effort and/or braking effort provided by one or more of the vehicles in the vehicle system 200 may be modified. As one example, the vehicle system 200 may be traveling along the route 106 according to a trip plan that designates operational settings (e.g., speeds, throttle settings, brake settings, and the like) as a function of at least one of time or distance along the route 106 in order to maintain the amount of slack in the vehicle system 200 within one or more designated limits. The actual operational settings that are used to control the vehicle system 200 (e.g., the actual throttle settings, actual brake settings, and the like) may slightly differ from the designated operational settings of the trip plan (e.g., due to unforeseen events, unplanned events, or information or events that occur but on which the trip plan is not based). These actual operational settings may be modified responsive to the slack condition indicating that the amount of slack at least one of exceeds or approaches exceeding the one or more designated limits of the trip plan.

As another example, if the vehicle system 200 is being manually controlled, the vehicle on which the operator is disposed may display instructions to the operator as to which throttle and/or brake settings to use for one or more of the vehicles in the vehicle system 200 to bring the slack condition closer to or within the acceptable limits, similar to as described above. Additionally or alternatively, the vehicle on which the operator is disposed may alter or reject manually selected throttle settings and/or brake settings for one or more of the vehicles in the vehicle system 200 that cause the slack condition to be outside of the designated limits. The vehicle may then implement different settings to bring the slack condition to within acceptable limits.

At 524, if the vehicle system 200 is operating according to the trip plan described above, the trip plan itself may be modified. For example, the actual slack condition that is determined (as described above) may significantly differ from the one or more limits that the trip plan is to keep the slack condition within. Such a significant difference may occur when the actual slack condition deviates from the one or more limits by at least a designated threshold.

When such a deviation occurs, the trip plan may need to be modified to establish different designated operational settings of a modified trip plan for future operation of the vehicle system 200. For example, due to one or more unforeseen or unplanned events, the operational settings currently designated by a trip plan may be incorrect to keep the actual slack conditions of the vehicle system 200 within the one or more designated limits. Therefore, these designated operational settings may need to be adjusted. In such an event, flow of the method 500 may proceed toward 526.

On the other hand, if no such deviation occurs, then the operational settings designated by the current trip plan may be sufficient to keep the actual slack conditions of the vehicle system 200 within the designated limits. In such an event, the vehicle system 200 may continue to operate according to the operational settings designated by the current trip plan. Flow of the method 500 may return to 502 or may continue with the vehicle system 200 operating according to the current trip plan and without repeating the operations described in connection with the method 500.

At 526, one or more operational settings of the trip plan are modified in order to create a modified trip plan. For example, the throttle settings, brake settings, speeds, or the like, that are designated by the trip plan may be changed to form a modified trip plan. The modified operational settings may alter control of the vehicle system 200 such that future slack conditions remain within the designated limits. Flow of the method 500 may return to 502 or may continue with the vehicle system 200 operating according to the modified trip plan and without repeating the operations described in connection with the method 500.

Figure 6:
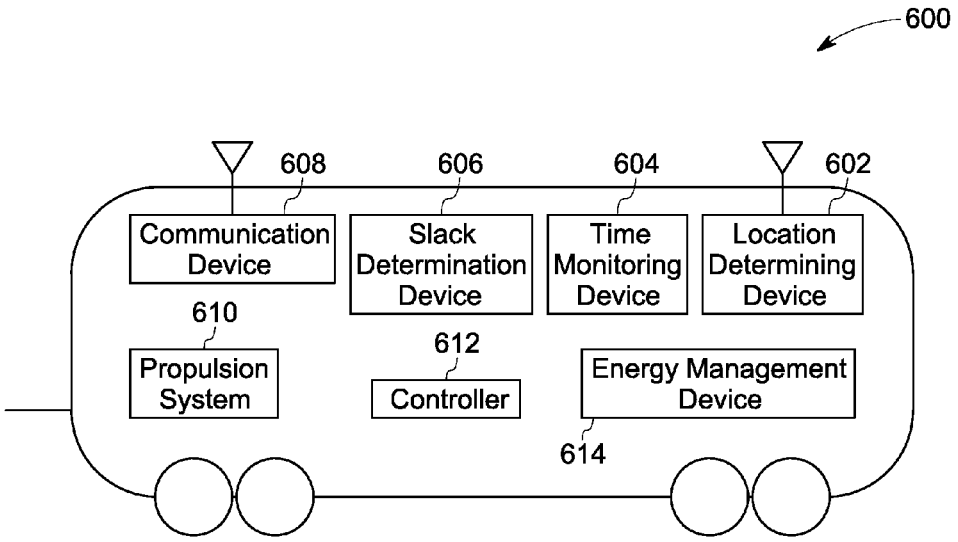
FIG. 6 is a schematic illustration of an embodiment of a vehicle.

FIG. 6 is a schematic illustration of an embodiment of a vehicle 600. The vehicle 600 may represent one or more of the vehicles 102, 202 shown in FIGS. 1 and 2, such as a leading vehicle 102, 202 in the vehicle systems 100, 200 shown in FIGS. 1 and 2. While the description herein focuses on the vehicle 600 being a leading vehicle in the vehicle systems 100, 200, alternatively, the vehicle 600 may be a following vehicle. For example, the vehicle 600 may follow behind a leading vehicle in the same vehicle system 100, 200, but also may send the request messages to the leading vehicle that indicate the designated location 206 at which the leading vehicle is to report back when the leading vehicle reaches the designated location 206.

The vehicle 600 includes several devices, systems, and a controller that may be coupled with each other by one or more wired and/or wireless connections (not shown), such as wireless networks, conductive paths, and the like. The devices, systems, and/or controller may include or represent one or more processors, controllers, or other logic based devices (and/or associated hardware, circuitry, and/or software stored on a tangible and non-transitory computer readable medium or memory).

The vehicle 600 includes a location determining device 602 that determines locations of the vehicle 600 as the vehicle 600 travels along the route 106 (shown in FIG. 1). The location determining device 602 may include or represent a global positioning system (GPS) receiver (and associated hardware and/or circuitry), a wireless cellular antenna (and associated hardware and/or circuitry), trackside transponders (e.g., that interrogate or are interrogated by a device onboard the vehicle 600 for communicating and/or determining a location of the vehicle 600), or another device that determines the locations of the vehicle 600 based on received signals, such as from GPS satellites, cellular phone towers, or the like.

A time monitoring device 604 of the vehicle 600 tracks time for the vehicle 600. As described above, the time monitoring device 604 may determine the time at which the vehicle 600 reaches the designated location 206 (shown in FIG. 2) based on the locations determined by the location determining device 602. For example, the time monitoring device 604 may include or represent a clock, timer, and/or one or more recording devices for logging the time at which the vehicle 600 reaches the designated location 206.

A slack determination device 606 determines the slack condition of the vehicle system 100, 200. The slack determination device 606 may calculate or estimate the slack condition of the vehicle system 100, 200 in a location between the leading and following vehicles 202, 204, in one example. If the vehicles 202, 204 are disposed at or near the opposite and outer front and back ends of the vehicle system 100, 200, then the slack condition may represent the slack condition of the entire vehicle system 100, 200. Optionally, if one or more of the vehicles 202, 204 are not located at the outer ends of the vehicle system 100, 200, then the slack condition that is determined may represent a slack condition of a subset of the vehicle system 100, 200. The slack determination device 606 may use multiple, different combinations or pairs of the vehicles 102, 202, 204 to determine the slack conditions in different sections and sub-sections of the vehicle system 100, 200.

As described above, the slack determination device 606 may determine the slack condition based on a time delay between when the vehicle 600 reaches the designated location 206 (as determined by the location determining device 602 and/or as manually input by an operator) and when a following vehicle (e.g., the vehicle 204 or the vehicle 700 described below) reaches the destination location 206, one or more speeds of the vehicle system 100, 200 (as reported from a controller described below and/or as monitored by the slack determination device 606 from one or more speed sensors, such as tachometers), and/or the path traversed by the route 106. With respect to the path traversed by the route 106, the slack determination device 606 may include and/or have access to a memory device (e.g., a tangible and non-transitory computer memory) having a database, list, table, or other memory structure that stores the shape of the route 106. This shape may represent grades, curves, linear portions, and the like, of the route 106 that the portion of the vehicle system 100, 200 between the leading and following vehicles travels over between the time when the leading vehicle reaches the designated location 106 and the time when the following vehicle reaches the designated location. This portion of the route 106 may include linear and/or non-linear portions. In an embodiment, the slack determination device 606 calculates the distance between the leading and following vehicles along the linear and/or non-linear portions of the route 106. For example, the separation distance 208 (shown in FIG. 2) may be measured over one or more non-linear portions of the route 106. Optionally, the slack determination device 606 may assume that the portion of the route 106 over which the vehicle system 100, 200 travels between the time when the leading vehicle reaches the designated location 106 and the time when the following vehicle reaches the designated location is a linear portion of the route 106. The slack determination device 606 may then calculate the separation distance 208 as described above.

A communication device 608 of the vehicle 600 communicates with other vehicles in the vehicle system 100, 200, such as the following vehicle 700 described below. The communication device 608 may include or represent an antenna (along with associated transceiver hardware circuitry and/or software applications) for wirelessly communicating with the following vehicle 700. The communication device 608 can communicate request messages (that inform another vehicle in the same vehicle system 100, 200 of an upcoming designated location 206), synchronization messages (that seek to synchronize the time monitoring device 604 with a time monitoring device of the other vehicle), response messages (that inform another vehicle in the same vehicle system 100, 200 of when this vehicle 600 reaches the designated location 206), and/or one or more other messages.

A propulsion system 610 includes components and assemblies that perform work to create movement the vehicle 600. For example, the propulsion system 610 may include or represent one or more engines, generators and/or alternators (and associated circuitry), traction motors, brakes, and the like. The propulsion system 610 also may include or represent one or more brakes or brake systems of the vehicle 600.

A controller 612 disposed onboard the vehicle 600 controls one or more operations of the vehicle 600 and/or vehicle system 100, 200. The controller 612 may be manually operated by an onboard operator to control tractive efforts and/or braking efforts generated by the propulsion system 610. The controller 612 can include, represent, and/or be coupled with one or more input devices, such as switches, levers, buttons, keyboards, microphones, touchscreens, or the like, that are actuated by the operator to control and/or change tractive and/or braking efforts of the vehicle 600.

Optionally, the controller 612 may be used to control the tractive and/or braking efforts of one or more other propulsion-generating vehicles in the same vehicle system 100, 200 as the vehicle 600. For example, if the vehicle system 100, 200 that includes the vehicle 600 is operating in a DP configuration, then the controller 612 may be used to automatically and/or manually coordinate the tractive efforts (e.g., throttle positions) and/or braking efforts (e.g., applied brake levels) of the propulsion-generating vehicles in the vehicle system 100, 200 from the vehicle 600.

The controller 612 may include or be coupled with one or more speed sensors that determine speeds at which the vehicle 600 and/or vehicle system 100, 200 are traveling. These speeds may be used to determine the slack conditions, as described herein. The controller 612 can select one or more locations as the designated location 206, such as from a database, list, table, or other memory structure, that is included in and/or accessible by the controller 612. As described above, the controller 612 may select the designated location 206 as the same location or near a feature of interest in the route 106. Optionally, the designated location 206 may be manually selected using the controller 612.

Based on the slack conditions determined by the slack determination device 606, the controller 612 may adjust, limit, or otherwise modify the manually controlled operations of the vehicle 600 and/or vehicle system 100, 200. For example, if the slack condition that is determined (as described herein) exceeds one or more limits, then the controller 612 may prevent the operator from manually increasing throttle settings (or brake settings) in such a way that would cause the slack condition to further exceed these designated limits (e.g., become even greater than an upper limit or even smaller than a lower limit). In one aspect, the controller 612 may change the manually initiated changes to the throttle settings and/or brake settings so that these adjusted settings prevent the slack condition from further exceeding these designated limits Optionally, the controller 612 may automatically control tractive and/or braking efforts of the vehicle 600 using a trip plan. The trip plan may be provided from an off-board source (e.g., a dispatch center that communicates the trip plan to the controller 612) or by an onboard energy management device 614. The energy management device 614 may be located off-board of the vehicle 600. The energy management device 614 may include or represent one or more processors, controllers, or other logic based devices (and/or associated hardware, circuitry, and/or software stored on a tangible and non-transitory computer readable medium or memory) that create and/or modify trip plans for the vehicle system 100, 200 that includes the vehicle 600. The trip plan may be based on a variety of relevant information, such as the size (e.g., length and/or weight) of the vehicle system 100, 200, the distribution of size (e.g., the distribution of weight) throughout the vehicle system 100, 200, the contents of the vehicle system 100, 200 (e.g., the number, type, capabilities, locations, and the like, of the propulsion-generating vehicles in the vehicle system 100, 200), the terrain (e.g., grades, curvatures, locations of tunnels, locations of slow orders, speed limits, and the like) over which the vehicle system 100, 200 is to travel for the trip, the schedule by which the vehicle system 100, 200 is to travel according to for the trip, weather conditions, types of fuel being used, emissions restrictions on travel of the vehicle system 100, 200, and/or other factors.

The trip plan created and/or modified by the energy management device 614 designates operational settings of the vehicle system 100, 200 for a trip. These operational settings may be designated as a function of time and/or distance along the route 106 (shown in FIG. 1) for the trip to one or more locations (e.g., one or more intermediate or final locations). By way of example only, the operational settings that may be designated include, but are not limited to, speeds, accelerations, power outputs, throttle settings, brake settings, applications of rail lubricants, forces exerted on coupling mechanisms 104, or the like. An example trip plan may designate forces experienced by the coupling mechanisms 104, such as limits on these forces, that differ at various locations and/or times along the trip. The controller 612 may automatically control throttle and/or brake settings of the vehicle system 100, 200 in an attempt to maintain the actual forces experienced by the coupling mechanisms 104 to within the limits designated by the trip plan. Additionally or alternatively, a trip plan may designate throttle settings and/or brake settings that differ at various locations and/or times along the trip. The controller 612 may automatically control throttle and/or brake settings of the vehicle system 100, 200 in an attempt to have the actual throttle and/or brake settings match the throttle and/or brake settings designated by the trip plan. Optionally, the energy management device 614 and/or the controller 612 may instruct the operator how to manually control operations of the vehicle 600 and/or vehicle system 100, 200 according to the trip plan. For example, the energy management device 614 and/or controller 612 may visually, audibly, and/or tactically present instructions to an operator on how to control the vehicle 600 and/or vehicle system 100, 200 according to the trip plan via one or more output devices (e.g., display screens; touchscreens; speakers; tactically actuated levers, buttons, switches, and the like).

In one aspect, the trip plan is created such that operating the vehicle system 100, 200 and/or vehicle 600 according to the designated operational settings of the trip plan causes the vehicle system 100, 200 and/or vehicle 600 to consume less fuel, produce fewer emissions, and/or maintain forces exerted on the coupling mechanisms 104 to within designated limits relative to another trip plan having different designated operational settings and/or relative to manual control of the vehicle 600 and/or vehicle system 100, 200. With respect to the limits on the forces exerted on the coupling mechanisms 104, these limits may be upper (e.g., maximum) limits, lower (e.g., minimum) limits, and/or ranges (e.g., upper and lower) of limits.

As described above, the trip plan may be modified if the slack condition determined by the slack determination device 606 indicates that the amount of slack exceeds or is approaching one or more of these limits on the amount of slack. For example, the energy management device 614 may monitor the slack condition to determine if the amount of slack is exceeding one or more designated limits and/or is approaching one or more of these limits. If the amount of slack is approaching and/or exceeding a limit, the energy management device 614 may change the designated operational settings of a currently used trip plan to different, modified operational settings of a modified trip plan for at least an upcoming segment of the route 106.

Figure 7:
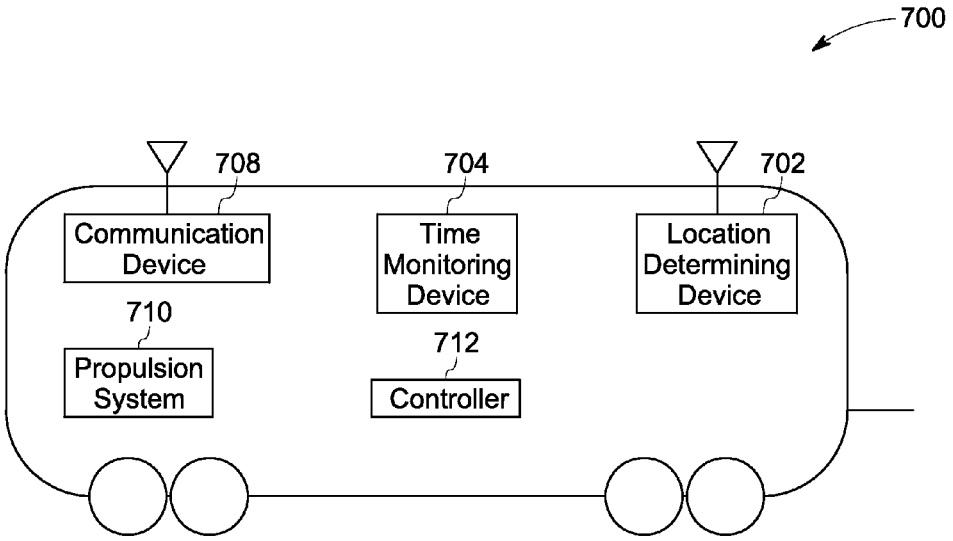
FIG. 7 is another schematic illustration of an embodiment of a vehicle.

FIG. 7 is another schematic illustration of an embodiment of a vehicle 700. The vehicle 700 may represent one or more of the vehicles 102, 204 shown in FIGS. 1 and 2, such as a following vehicle 102, 204 in the vehicle systems 100, 200 shown in FIGS. 1 and 2. While the description herein focuses on the vehicle 600 being a following vehicle in the vehicle systems 100, 200, alternatively, the vehicle 700 may be a leading vehicle as described herein. For example, the vehicle 700 may travel ahead of a following vehicle in the same vehicle system 100, 200, but also may receive the request messages from the following vehicle and report back when the vehicle 700 reaches a designated location 206 to the following vehicle.

The vehicle 700 includes several devices, systems, and a controller that may be coupled with each other by one or more wired and/or wireless connections (not shown), such as wireless networks, conductive paths, and the like. The devices, systems, and/or controller may include or represent one or more processors, controllers, or other logic based devices (and/or associated hardware, circuitry, and/or software stored on a tangible and non-transitory computer readable medium or memory).

The vehicle 700 includes a location determining device 702 that may be similar to the location determining device 602 (shown in FIG. 6), a time monitoring device 704 that may be similar to the time monitoring device 604 (shown in FIG. 6), a communication device 708 that may be similar to the communication device 608 (shown in FIG. 6), a propulsion system 710 that may be similar to the propulsion system 610 (shown in FIG. 6), and a controller 712 that may be similar to the controller 612 (shown in FIG. 6). The communication device 708 may receive a synchronization message from another vehicle in the same vehicle system 100, 200. In response to receiving this message, the controller 712 may change or adjust the time being monitored by the time monitoring device 704 (to synchronize the time being monitored by the time monitoring device 704 with the time being monitored by the time monitoring device 604.

The controller 712 may determine when the vehicle 700 reaches the designated location 206. The controller 712 may examine the locations of the vehicle 700 as determined by the location determining device 702 and determine when the vehicle 700 reaches the designated location 206. The controller 712 identifies the time at which the vehicle 700 reaches the designated location 206 and reports this time to another vehicle, such as the leading vehicle or the vehicle that sent the request message, as described above.

In an embodiment, a method (e.g., for determining a slack condition of a vehicle system) includes determining when each of a first vehicle and a second vehicle in a vehicle system reaches a designated location along a route being traveled by the vehicle system. The vehicle system includes at least the first and second vehicles interconnected with each other. The method also includes communicating a response message from the second vehicle to the first vehicle responsive to the second vehicle reaching the designated location, calculating a separation distance between the first vehicle and the second vehicle based on a time delay between a first time when the first vehicle reached the designated location and a second time when the second vehicle reached the designated location, and determining a slack condition of the vehicle system based on the separation distance. The slack condition is representative of an amount of slack in the vehicle system between the first and second vehicles.

In one aspect, the first vehicle is disposed ahead of the second vehicle in the vehicle system along a direction of travel of the vehicle system. The method also may include communicating a request message from the first vehicle to the second vehicle. The request message identifies the designated location along the route. The response message can be communicated from the second vehicle to the first vehicle responsive to the second vehicle receiving the request message and the second vehicle reaching the designated location.

In one aspect, determining the slack condition includes comparing the separation distance with a designated distance between the first vehicle and the second vehicle in the vehicle system and along the route, the slack condition representing a greater amount of slack in the vehicle system when the designated distance exceeds the separation distance and the slack condition representing a smaller amount of slack in the vehicle system when the separation distance exceeds the designated distance.

In one aspect, calculating the separation distance includes calculating a distance along a path of the route between the first vehicle and the second vehicle using the time delay and a velocity of the vehicle system.

In one aspect, the first vehicle and the second vehicle include respective time monitoring devices that track time. The method may further include synchronizing the time monitoring devices of the first and second vehicles prior to determining when each of the first vehicle and the second vehicle reaches the designated location.

In one aspect, the method also includes selecting the designated location from plural potential locations along the route. The designated location may be selected as being representative of a location of a feature of interest in terrain of the route.

In one aspect, the feature of interest in the terrain of the route includes an inflection point in grades of the route.

In one aspect, the feature of interest in the terrain of the route includes at least one of a valley disposed between a decline and an incline in the route, a start of an inclined portion of the route, an end of a declined portion of the route, or an apex between an incline and a decline in the route.

In one aspect, the vehicle system is traveling along the route according to a trip plan that designates operational settings as a function of at least one of time or distance along the route in order to maintain the amount of slack within one or more designated limits. The method also may include modifying actual operational settings used to control the vehicle system responsive to the slack condition that is determined indicating that the amount of slack at least one of exceeds or approaches exceeding the one or more designated limits.

In one aspect, the vehicle system is traveling along the route according to a trip plan that designates operational settings as a function of at least one of time or distance along the route in order to maintain the amount of slack within one or more designated limits. The method also includes modifying the operational settings designated by the trip plan for at least an upcoming segment of the route responsive to the slack condition that is determined indicating that the amount of slack at least one of exceeds or approaches exceeding the one or more designated limits.

In one aspect, the separation distance is calculated along a non-linear path of the route.

In an embodiment, a system (e.g., for determining a slack condition of a vehicle system) includes a location determination device, a time monitoring device, and a slack determination device. The location determination device is configured to be disposed onboard a first vehicle of a vehicle system that also includes at least a second vehicle interconnected with the first vehicle for traveling along a route. The location determination device also is configured to determine locations of the first vehicle along the route. The time monitoring device is configured to determine when the first vehicle reaches a designated location along the route based on one or more of the locations determined by the location determination device. The slack determination device is configured to be disposed onboard the first vehicle and configured to receive a response message communicated by the second vehicle to the first vehicle. The response message identifies when the second vehicle reached the designated location. The slack determination device also is configured to calculate a separation distance between the first vehicle and the second vehicle based on a time delay between a first time when the first vehicle reached the designated location and a second time when the second vehicle reached the designated location. The slack determination device is further configured to determine a slack condition of the vehicle system based on the separation distance. The slack condition is representative of an amount of slack in the vehicle system between the first and second vehicles.

In one aspect, the slack determination device is configured to compare the separation distance with a designated distance between the first vehicle and the second vehicle in the vehicle system and along the route. The slack condition represents a greater amount of slack in the vehicle system when the designated distance exceeds the separation distance and the slack condition representing a smaller amount of slack in the vehicle system when the separation distance exceeds the designated distance.

In one aspect, the slack determination device is configured to calculate the separation distance by determining a distance along a path of the route between the first vehicle and the second vehicle using the time delay and a velocity of the vehicle system.

In one aspect, the first vehicle is disposed ahead of the second vehicle in the vehicle system along a direction of travel of the vehicle system. The system can include a controller disposed onboard the first vehicle that directs a communication device of the first vehicle to communicate a request message from the first vehicle to the second vehicle. The request message identifies the designated location along the route. The response message is communicated from the second vehicle to the first vehicle responsive to the second vehicle receiving the request message and the second vehicle reaching the designated location.

In one aspect, the second vehicle includes a second time monitoring device. The first time monitoring device (of the first vehicle) is configured to synchronize time monitored by the first time monitoring device with time that is monitored by the second time monitoring device prior to the first time monitoring device determining when the first vehicle reaches the designated location and prior to the second time monitoring device determining when the second vehicle reaches the designated location.

In one aspect, the system also includes a controller configured to select the designated location from plural potential locations along the route. The designated location can be selected as being representative of a location of a feature of interest in terrain of the route.

In one aspect, the feature of interest in the terrain of the route includes an inflection point in grades of the route.

In one aspect, the feature of interest in the terrain of the route includes at least one of a valley disposed between a decline and an incline in the route, a start of an inclined portion of the route, an end of a declined portion of the route, or an apex between an incline and a decline in the route.

In one aspect, the system also can include a controller configured to at least one of autonomously control operations of the vehicle system according to a trip plan or direct an operator of the vehicle system to manually control operations of the vehicle system according to the trip plan. The trip plan designates operational settings as a function of at least one of time or distance along the route in order to maintain the amount of slack within one or more designated limits. The controller can be configured to modify actual operational settings used to control the vehicle system responsive to the slack condition that is determined indicating that the amount of slack at least one of exceeds or approaches exceeding the one or more designated limits.

In one aspect, the system also includes an energy management device configured to determine a trip plan for the vehicle system to travel along the route. The trip plan designates operational settings as a function of at least one of time or distance along the route in order to maintain the amount of slack within one or more designated limits. The energy management system is configured to modify the operational settings designated by the trip plan for at least an upcoming segment of the route responsive to the slack condition that is determined indicating that the amount of slack at least one of exceeds or approaches exceeding the one or more designated limits.

In one aspect, the slack determination device is configured to calculate the separation distance along a non-linear path of the route.

In an embodiment, a system (e.g., for determining a slack condition of a vehicle system) includes a communication device, a location determination device, and a second time monitoring device. The communication device is configured to receive a request message from a leading vehicle in a vehicle system that also includes at least a following vehicle interconnected with the leading vehicle for traveling along a route. The leading vehicle is disposed ahead of the following vehicle in the vehicle system along a direction of travel of the vehicle system. The request message identifies an upcoming designated location along the route. The location determination device is configured to be disposed onboard the following vehicle and to determine locations of the following vehicle along the route. The second time monitoring device is configured to determine when the following vehicle reaches the designated location along the route based on one or more of the locations determined by the location determination device. The second time monitoring device also is configured to determine when the following vehicle reaches the designated location responsive to the following vehicle receiving a request message from the leading vehicle that identifies the designated location. The communication device also is configured to communicate a response message to the leading vehicle. The response message indicates when the following vehicle reached the designated location for use by a slack determining device of the leading vehicle to determine a slack condition of the vehicle system between the leading and following vehicles based on a difference in time between when the leading vehicle reached the designated location and when the following vehicle reached the designated location.

In one aspect, the second time monitoring device is configured to synchronize time being monitored by the second time monitoring device with time that is monitored by a first time monitoring device of the leading vehicle prior to the first time monitoring device determining when the leading vehicle reaches the designated location and prior to the second time monitoring device determining when the following vehicle reaches the designated location.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described systems and methods without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

The invention claimed is:

1. A method comprising:

determining when each of a first vehicle and a second vehicle in a vehicle system reaches a designated location along a route being traveled by the vehicle system, the vehicle system including at least the first and second vehicles interconnected with each other;

communicating a response message from the second vehicle to the first vehicle responsive to the second vehicle reaching the designated location;

calculating a separation distance between the first vehicle and the second vehicle based on a time delay between a first time when the first vehicle reached the designated location and a second time when the second vehicle reached the designated location; and determining a slack condition of the vehicle system based on the separation distance, the slack condition representative of an amount of slack in the vehicle system between the first and second vehicles.

2. The method of claim 1, wherein the first vehicle is disposed ahead of the second vehicle in the vehicle system along a direction of travel of the vehicle system, and further comprising communicating a request message from the first vehicle to the second vehicle, the request message identifying the designated location along the route, wherein the response message is communicated from the second vehicle to the first vehicle responsive to the second vehicle receiving the request message and the second vehicle reaching the designated location.

3. The method of claim 1, wherein determining the slack condition includes comparing the separation distance with a designated distance between the first vehicle and the second vehicle in the vehicle system and along the route, the slack condition representing a greater amount of slack in the vehicle system when the designated distance exceeds the separation distance and the slack condition representing a smaller amount of slack in the vehicle system when the separation distance exceeds the designated distance.

4. The method of claim 1, wherein calculating the separation distance includes calculating a distance along a path of the route between the first vehicle and the second vehicle using the time delay and a velocity of the vehicle system.

5. The method of claim 1, wherein the first vehicle and the second vehicle include respective time monitoring devices that track time, and further comprising synchronizing the time monitoring devices of the first and second vehicles prior to determining when each of the first vehicle and the second vehicle reaches the designated location.

6. The method of claim 1, further comprising selecting the designated location from plural potential locations along the route, the designated location selected as being representative of a location of a feature of interest in terrain of the route.

7. The method of claim 6, wherein the feature of interest in the terrain of the route includes an inflection point in grades of the route.

8. The method of claim 6, wherein the feature of interest in the terrain of the route includes at least one of a valley disposed between a decline and an incline in the route, a start of an inclined portion of the route, an end of a declined portion of the route, or an apex between an incline and a decline in the route.

9. The method of claim 1, wherein the vehicle system is traveling along the route according to a trip plan that designates operational settings as a function of at least one of time or distance along the route in order to maintain the amount of slack within one or more designated limits, and further comprising modifying actual operational settings used to control the vehicle system responsive to the slack condition that is determined indicating that the amount of slack at least one of exceeds or approaches exceeding the one or more designated limits.

10. The method of claim 1, wherein the vehicle system is traveling along the route according to a trip plan that designates operational settings as a function of at least one of time or distance along the route in order to maintain the amount of slack within one or more designated limits, and further comprising modifying the operational settings designated by the trip plan for at least an upcoming segment of the route responsive to the slack condition that is determined indicating that the amount of slack at least one of exceeds or approaches exceeding the one or more designated limits.

11. The method of claim 1, wherein the separation distance is calculated along a non-linear path of the route.

12. A system comprising:

a location determination device configured to be disposed onboard a first vehicle of a vehicle system that also includes at least a second vehicle interconnected with the first vehicle for traveling along a route, the location determination device configured to determine locations of the first vehicle along the route;

a first time monitoring device configured to determine when the first vehicle reaches a designated location along the route based on one or more of the locations determined by the location determination device; and a slack determination device configured to be disposed onboard the first vehicle and configured to receive a response message communicated by the second vehicle to the first vehicle, the response message identifying when the second vehicle reached the designated location, the slack determination device also configured to calculate a separation distance between the first vehicle and the second vehicle based on a time delay between a first time when the first vehicle reached the designated location and a second time when the second vehicle reached the designated location, wherein the slack determination device also is configured to determine a slack condition of the vehicle system based on the separation distance, the slack condition representative of an amount of slack in the vehicle system between the first and second vehicles.

13. The system of claim 12, wherein the slack determination device is configured to compare the separation distance with a designated distance between the first vehicle and the second vehicle in the vehicle system and along the route, the slack condition representing a greater amount of slack in the vehicle system when the designated distance exceeds the separation distance and the slack condition representing a smaller amount of slack in the vehicle system when the separation distance exceeds the designated distance.

14. The system of claim 12, wherein the slack determination device is configured to calculate the separation distance by determining a distance along a path of the route between the first vehicle and the second vehicle using the time delay and a velocity of the vehicle system.

15. The system of claim 12, wherein the first vehicle is disposed ahead of the second vehicle in the vehicle system along a direction of travel of the vehicle system, and further comprising a controller disposed onboard the first vehicle that directs a communication device of the first vehicle to communicate a request message from the first vehicle to the second vehicle, the request message identifying the designated location along the route, wherein the response message is communicated from the second vehicle to the first vehicle responsive to the second vehicle receiving the request message and the second vehicle reaching the designated location.

16. The system of claim 12, wherein the second vehicle includes a second time monitoring device, the first time monitoring device configured to synchronize time monitored by the first time monitoring device with time that is monitored by the second time monitoring device prior to the first time monitoring device determining when the first vehicle reaches the designated location and prior to the second time monitoring device determining when the second vehicle reaches the designated location.

17. The system of claim 12, further comprising a controller configured to at least one of autonomously control operations of the vehicle system according to a trip plan or direct an operator of the vehicle system to manually control operations of the vehicle system according to the trip plan, the trip plan designating operational settings as a function of at least one of time or distance along the route in order to maintain the amount of slack within one or more designated limits, and wherein the controller is configured to modify actual operational settings used to control the vehicle system responsive to the slack condition that is determined indicating that the amount of slack at least one of exceeds or approaches exceeding the one or more designated limits.

18. The system of claim 12, further comprising an energy management device configured to determine a trip plan for the vehicle system to travel along the route, the trip plan designating operational settings as a function of at least one of time or distance along the route in order to maintain the amount of slack within one or more designated limits, and wherein the energy management system is configured to modify the operational settings designated by the trip plan for at least an upcoming segment of the route responsive to the slack condition that is determined indicating that the amount of slack at least one of exceeds or approaches exceeding the one or more designated limits.

19. A system comprising:

a communication device configured to receive a request message from a leading vehicle in a vehicle system that also includes at least a following vehicle interconnected with the leading vehicle for traveling along a route, the leading vehicle disposed ahead of the following vehicle in the vehicle system along a direction of travel of the vehicle system, the request message identifying an upcoming designated location along the route;

a location determination device configured to be disposed onboard the following vehicle and to determine locations of the following vehicle along the route; and a second time monitoring device configured to determine when the following vehicle reaches the designated location along the route based on one or more of the locations determined by the location determination device, the second time monitoring device configured to determine when the following vehicle reaches the designated location responsive to the following vehicle receiving a request message from the leading vehicle that identifies the designated location, wherein the communication device also is configured to communicate a response message to the leading vehicle, the response message indicating when the following vehicle reached the designated location for use by a slack determining device of the leading vehicle to determine a slack condition of the vehicle system between the leading and following vehicles based on a difference in time between when the leading vehicle reached the designated location and when the following vehicle reached the designated location.

20. The system of claim 19, wherein the second time monitoring device is configured to synchronize time being monitored by the second time monitoring device with time that is monitored by a first time monitoring device of the leading vehicle prior to the first time monitoring device determining when the leading vehicle reaches the designated location and prior to the second time monitoring device determining when the following vehicle reaches the designated location.

* * * * *